US010096212B1

(12) United States Patent
Lee

(10) Patent No.: US 10,096,212 B1
(45) Date of Patent: Oct. 9, 2018

(54) AUTOMATED TELLER MACHINE

(71) Applicant: Nautilus Hyosung Inc., Seoul (KR)

(72) Inventor: Jong Ok Lee, Hwaseong-si (KR)

(73) Assignee: Nautilus Hyosung Inc. (KR)

( * ) Notice: Subject to any disclaimer, the term of this patent is extended or adjusted under 35 U.S.C. 154(b) by 0 days.

(21) Appl. No.: 15/661,314

(22) Filed: Jul. 27, 2017

(30) Foreign Application Priority Data

Jun. 2, 2017 (KR) ..... 10-2017-0069242

(51) Int. Cl.
*G07F 9/10* (2006.01)
*G07F 19/00* (2006.01)
*G07D 11/00* (2006.01)

(52) U.S. Cl.
CPC ..... *G07F 19/205* (2013.01); *G07D 11/0003* (2013.01); *G07D 11/0081* (2013.01); *G07F 19/201* (2013.01); *G07F 19/202* (2013.01)

(58) Field of Classification Search
CPC ..... A47F 9/00; E05G 1/024; E05G 7/001; G07D 11/0003; G07D 11/0081; G07D 2211/00; G07F 19/20; G07F 19/205
See application file for complete search history.

(56) References Cited

U.S. PATENT DOCUMENTS 5,740,744 A * 4/1998 Nashirozawa ..... G07F 19/20 109/24.1
6,082,616 A * 7/2000 Lewis ..... G07F 19/20 235/379
8,413,786 B2 * 4/2013 Roatis ..... G07F 19/205 194/350

* cited by examiner

*Primary Examiner* — Mark J Beauchaine
(74) *Attorney, Agent, or Firm* — Fish & Richardson P.C.

(57) ABSTRACT

An automated teller machine includes a main body provided with a guide rail extending in a front-rear direction, a tray mounted in the main body, the tray being movable along the guide rail into and out of the main body, and a fascia rotatably installed at a front side of the tray. The tray includes a movable frame configured to move along the guide rail and provided with a cutout portion at a front end thereof. The tray further includes a tray cover provided at a front side of the movable frame to cover the cutout portion from below.

9 Claims, 10 Drawing Sheets

AUTOMATED TELLER MACHINE

CROSS-REFERENCE TO RELATED APPLICATIONS

This application is based on and claims priority to Korean Patent Application No. 10-2017-0069242, filed on Jun. 2, 2017, the disclosure of which is incorporated herein in its entirety by reference.

TECHNICAL FIELD

The present disclosure relates to an automated teller machine.

BACKGROUND

An automated teller machine may be defined as a device capable of providing financial services such as receiving of bills, dispensing of bills or the like without intervention of a bank teller regardless of time and location. For example, the automated teller machine is configured so that transactions such as deposit of bills, withdrawal of bills or the like can be performed in a user interface part by a user's operation using a medium such as a card or a bankbook.

In addition, in order to prevent other persons from illegally accessing and using the automated teller machine, the automated teller machine is designed to ask a user to first input a password prior to performing a financial processing function so that the financial processing function can be performed only when the inputted password matches with a pre-registered password.

As an example, the automated teller machine is provided with an EPP (Encrypting Pin Pad) in a user interface part thereof so that a user can input a password through the EPP, thereby encrypting and protecting a user's password.

However, in the case of a conventional automated teller machine, it is structurally possible to gain access to an EPP of a user interface part when a chest is opened. Thus, the EPP of the user interface part tends to be exposed to a security risk.

REFERENCE DOCUMENT

Korean Patent No. 10-0863744

SUMMARY

Embodiments of the present disclosure provide an automated teller machine capable of effectively preventing various components such as a keypad and the like from being exposed to a security risk.

In accordance with a first aspect of the present disclosure, there is provided an automated teller machine, including: a main body provided with a guide rail extending in a front-rear direction; a tray mounted in the main body, the tray being movable along the guide rail into and out of the main body; and a fascia rotatably installed at a front side of the tray, wherein the tray includes a movable frame configured to move along the guide rail and provided with a cutout portion at a front end thereof, and a tray cover provided at a front side of the movable frame to cover the cutout portion from below.

The tray cover may include: a cover body portion configured to cover the cutout portion; a cover bending portion configured to support a lower end of the fascia; and a recessed connection portion which bendably connects the cover body portion and the cover bending portion.

The tray may further include a tray support fixed to a front side of the movable frame to support a rear side of the tray cover.

The fascia may include: a panel part rotatably installed at a front end of the movable frame; a pad bracket part obliquely disposed at a lower side of the panel part; a keypad part mounted on the pad bracket part to allow a user to input personal information; and a display part mounted at an upper side of the panel part.

The main body may include: a housing mounted so that the tray is moved into and out of the housing; a chest located on a lower side of the housing and configured to store bills; a main body plate configured to partition the housing and the chest, the guide rail mounted on the main body plate; a chest door configured to open and close the chest; and a deposit/withdrawal stack part provided in the chest door so that bills are deposited and withdrawn through the deposit/withdrawal stack part.

In accordance with a second aspect of the present disclosure, there is provided an automated teller machine, including: a housing forming an upper outer shell of the automated teller machine together with a fascia defining a front surface of the automated teller machine; a chest installed on a lower side of the housing; a tray coupled to the fascia and configured to slidingly move into and out of the housing; and a tray cover installed at a lower portion of the tray and configured to prevent access to an interior of the housing through a gap between the fascia and the tray.

The fascia may include a keypad part configured to receive an input of information, a cutout portion may be formed in the tray to avoid interference of the tray with the keypad part, and the tray cover may extend to the cutout portion to prevent access to the interior of the housing.

The tray cover may include: a cover body portion installed below the cutout portion so as to cover the cutout portion; and a cover bending portion connected to the cover body portion to cover a gap between the fascia and the tray.

A lower end portion of the fascia may be hingedly coupled to the tray, and the cover bending portion may be connected to the cover body portion through a recessed connection portion so that the cover bending portion is rotated together with the fascia when the fascia is rotated frontward.

According to the embodiments of the present disclosure, the gap left between the tray and the keypad part disposed in the cutout portion is closed by the tray cover for protecting the cutout portion of the tray. This provides an advantage in that it is possible to effectively prevent the keypad part from being exposed to a security risk when a chest is opened.

Furthermore, according to the embodiments of the present disclosure, the fascia is rotatably installed in the movable frame. This provides an advantage in that when the fascia is rotated, it is possible to secure a work space for effective maintenance and repair of the fascia.

DETAILED DESCRIPTION

Figure 1:
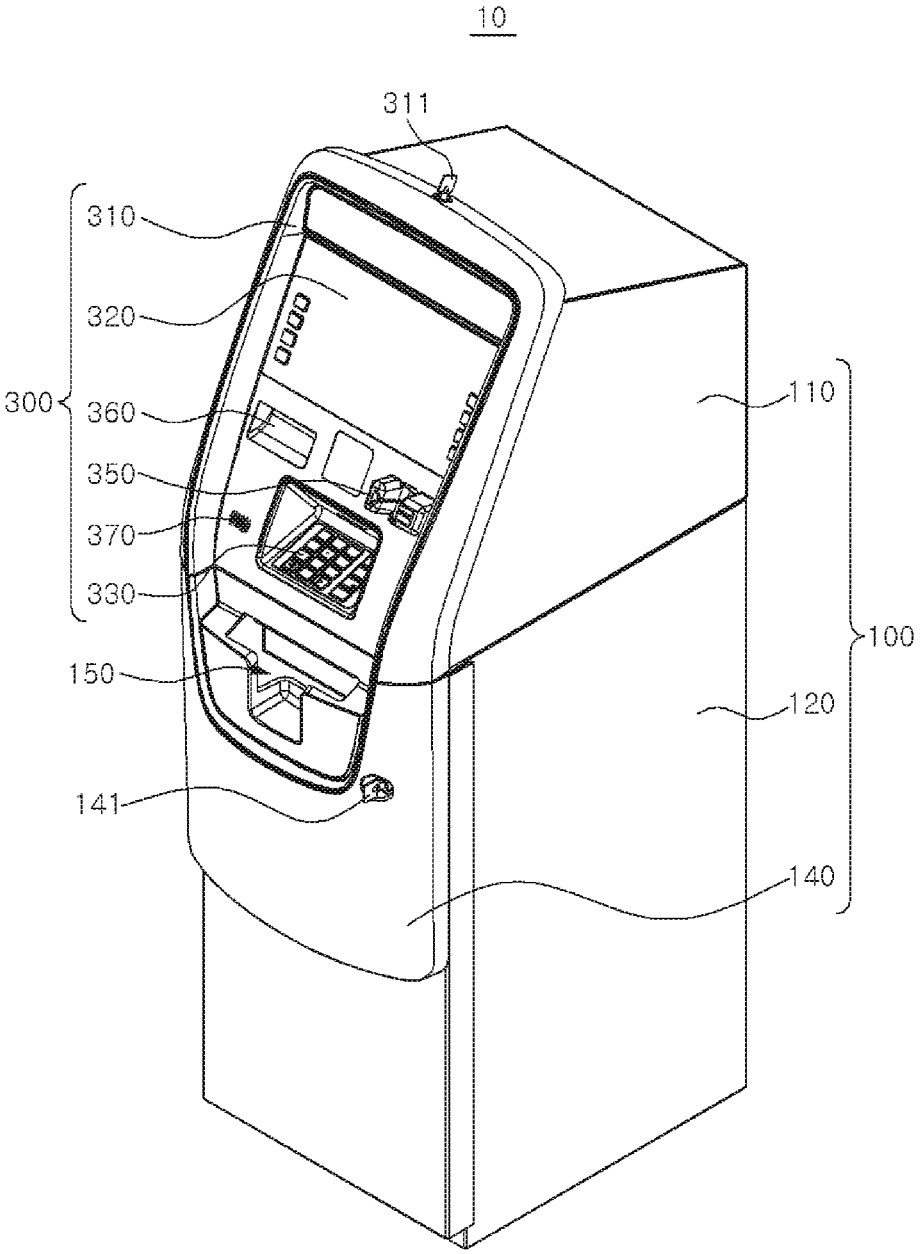
FIG. 1 is a perspective view showing an automated teller machine according to one embodiment of the present disclosure.

Hereinafter, configurations and operations of embodiments will be described in detail with reference to the accompanying drawings. The following description is one of various patentable aspects of the disclosure and may form a part of the detailed description of the disclosure. However, in describing the disclosure, detailed descriptions of known configurations or functions are omitted to avoid obscure the disclosure.

The disclosure may be variously modified and may include various embodiments. Specific embodiments will be exemplarily illustrated in the drawings and described in the detailed description of the embodiments. However, it should be understood that they are not intended to limit the disclosure to specific embodiments but rather to cover all modifications, similarities, and alternatives which are included in the spirit and scope of the disclosure.

The terms used herein, including ordinal numbers such as "first" and "second" may be used to describe, and not to limit, various components. The terms simply distinguish the components from one another. When it is said that a component is "coupled" or "linked" to another component, it should be understood that the former component may be directly connected or linked to the latter component or a third component may be interposed between the two components. Specific terms used in the present application are used simply to describe specific embodiments without limiting the disclosure. An expression used in the singular encompasses the expression of the plural, unless it has a clearly different meaning in the context.

Figure 2:
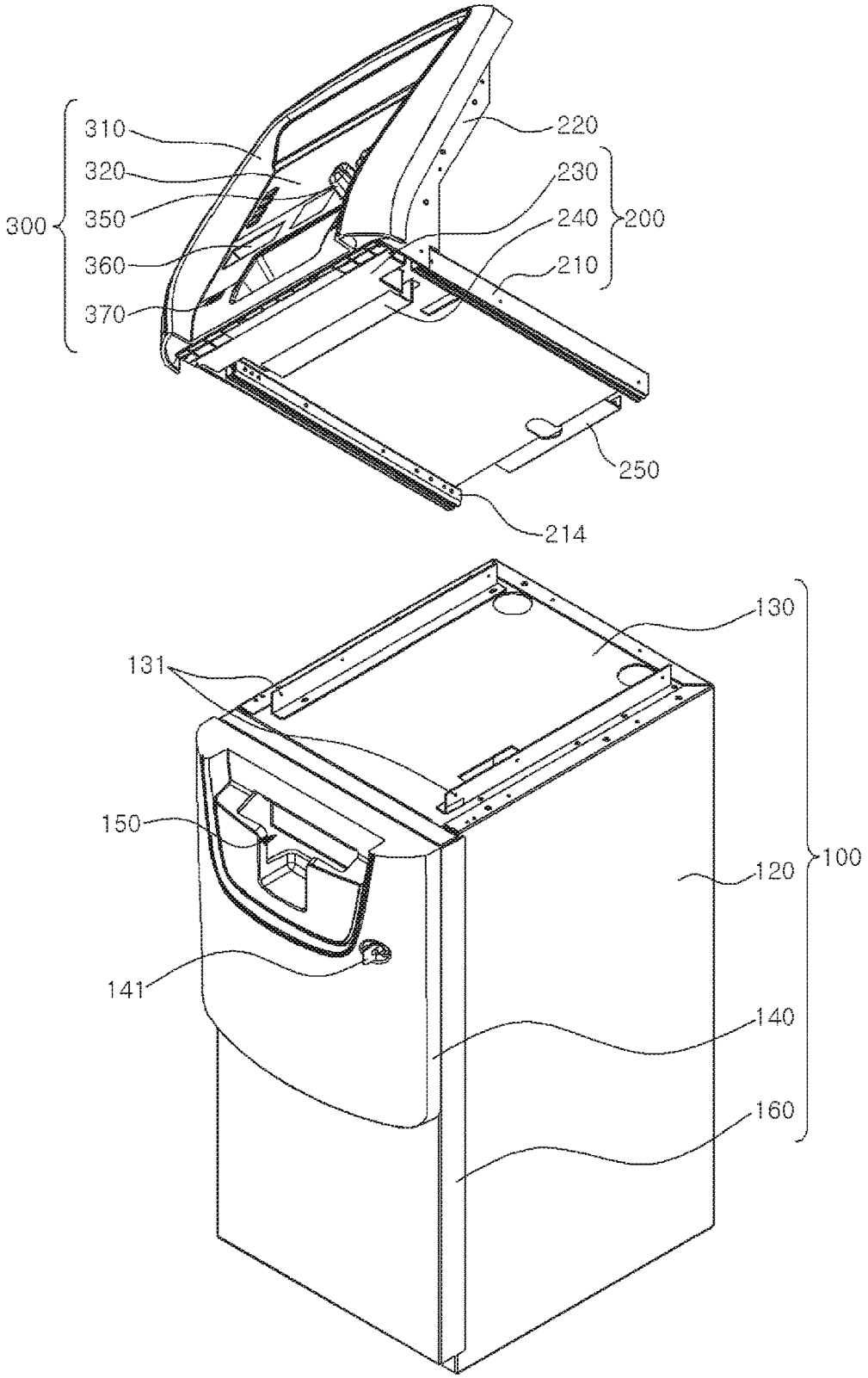
FIG. 2 is an exploded perspective view showing the automated teller machine according to one embodiment of the present disclosure.

FIG. 1 is a perspective view showing an automated teller machine according to one embodiment of the present disclosure. FIG. 2 is an exploded perspective view showing the automated teller machine according to one embodiment of the present disclosure.

As shown in FIGS. 1 and 2, an automated teller machine 10 according to one embodiment of the present disclosure may include a main body 100 provided with a guide rail 131, a tray 200 configured to be moved into and out of the main body 100 along the guide rail 131, and a fascia 300 provided in the tray 200.

Specifically, the main body 100 is a casing that constitutes the outer shell of the automated teller machine 10. The main body 100 may include a housing 110, a chest 120, a main body plate 130, a chest door 140, a deposit/withdrawal stack part 150 and a cash box door 160.

In this regard, the housing 110 may be provided as an upper casing of the automated teller machine 10. An internal space into and out of which the tray 200 can be moved may be formed inside the housing 110. The guide rail 131 extending in the front-rear direction may be provided in the internal space. As an example, the guide rail 131 may be installed on the main body plate 130.

The chest 120 may be provided as a lower casing of the automated teller machine 10. A cash dispenser unit (CDU) for dispensing bills may be installed inside the chest 120. Needless to say, depending on the model and specification of the automated teller machine, a cash receiving/dispensing unit for receiving and dispensing bills may be accommodated inside the chest 120.

In addition, the chest 120 may provide an accommodation space for storing bills or the like. Various cassettes for storing bills or the like may be disposed in the accommodation space. As the cassettes disposed in the accommodation space, it may be possible to use, for example, a recycle cassette for storing a specific kind of bills, a reject cassette for temporarily storing bills to be returned, a transit cassette for storing bills to be supplemented or recovered, and so forth.

The main body plate 130 may be mounted on the upper end of the chest 120 so as to partition the housing 110 and the chest 120. The guide rail 131 extending in the front-rear direction of the main body 100 may be mounted on the upper surface of the main body plate 130. The guide rail 131 may be formed of a pair of rails juxtaposed on the upper surface of the main body plate 130. When the tray 200 is moved, the guide rail 131 may guide a sliding rail 214 of the tray 200, which will be described later, in the front-rear direction of the main body 100.

The chest door 140 may be installed on the front side of the chest 120 to open and close the accommodation space of the chest 120. In particular, in order to selectively open the accommodation space of the chest 120, a locking key 141 for locking the chest door 140 to the chest 120 may be provided in the chest door 140. The chest door 140 may close the chest 120 by the locking action of the locking key and may open the chest 120 by the unlocking action of the locking key.

The deposit/withdrawal stack part 150 may be provided in the chest door 140 so that bills can be deposited and withdrawn. Thus, the bills deposited to the automated teller machine 10 through the deposit/withdrawal stack part 150 may be stored in the cassette existing inside the chest 120. The bills stored in the cassette may be withdrawn to the outside of the automated teller machine 10 through the deposit/withdrawal stack part 150. The deposit/withdrawal stack part 150 corresponds in configuration to a typical deposit/withdrawal device in which bills are deposited and withdrawn. Therefore, detailed description thereof will be omitted.

The cash box door 160 may protect the bills stored in the accommodation space of the chest 120 from an unauthorized person's access. At the cash box door 160, there may be provided a locking device (not shown) (e.g., an electronic lock or a dial lock) for locking the cash box door 160 and a handle (not shown) for opening the cash box door to open the accommodation space of the chest 120.

Figure 3:
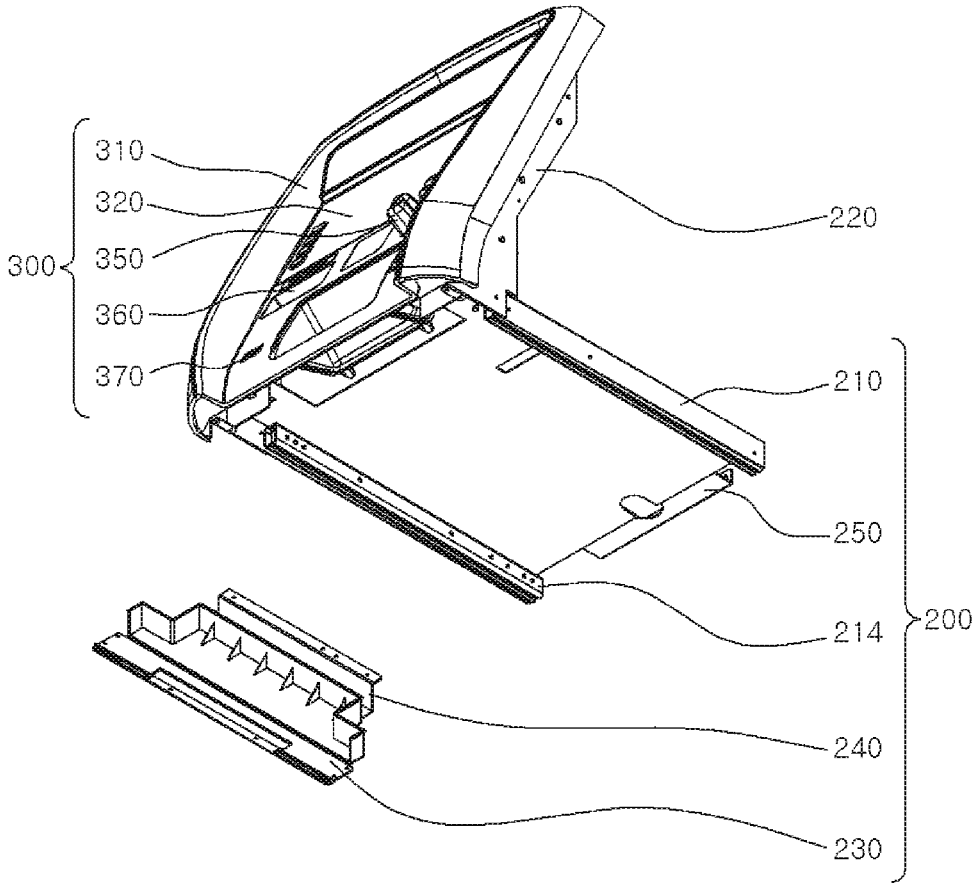
FIG. 3 is an exploded perspective view showing a tray of the automated teller machine according to one embodiment of the present disclosure.
Figure 4:
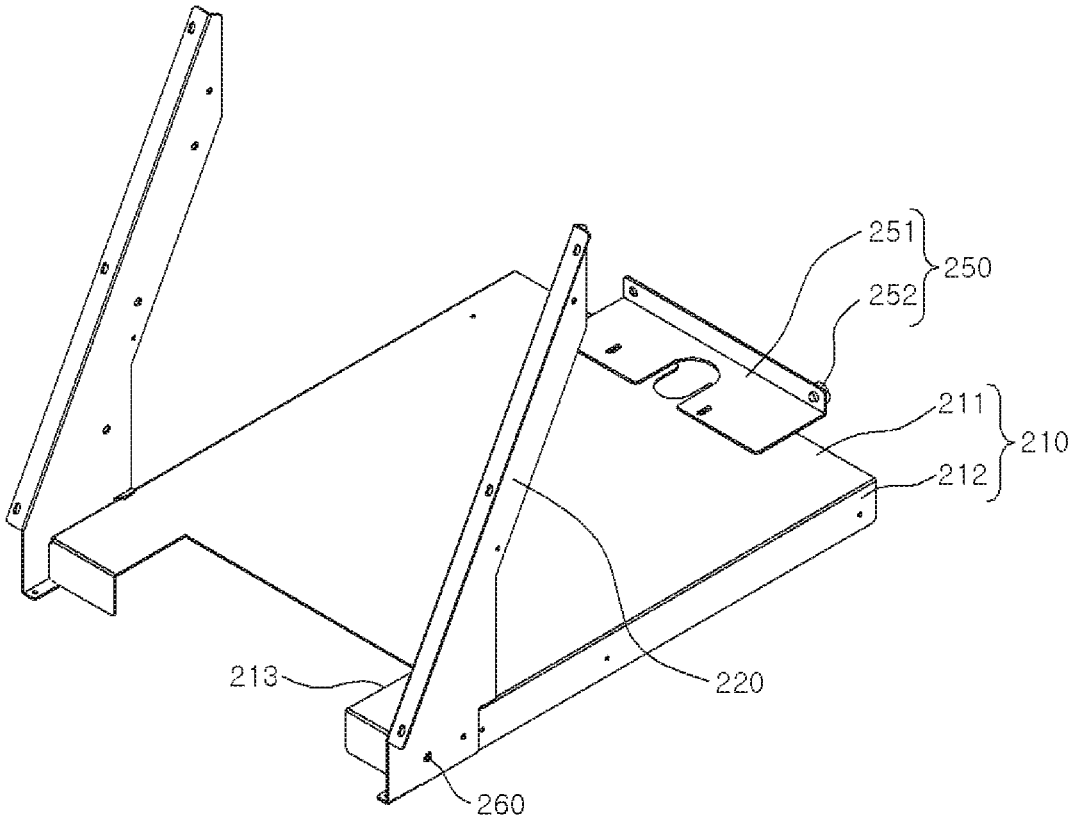
FIG. 4 is a perspective view showing a movable frame of a tray and a fascia according to one embodiment of the present disclosure.

Thus, even when the chest door 140 or the cash box door 160 is opened in a state in which the tray 200 is moved into the housing 110, the access to a keypad part 330 through a cutout portion 213 to be described later may be blocked by a tray cover 230. FIG. 3 is an exploded perspective view showing the tray of the automated teller machine according to one embodiment of the present disclosure. FIG. 4 is a perspective view showing a movable frame of the tray and the fascia according to one embodiment of the present disclosure.

As shown in FIGS. 3 and 4, the tray 200 may be installed in the housing 110 of the main body 100 and may provide an installation space on which components can be seated. As an example, components such as a power supply part, a specification output part and the like may be seated on the tray 200.

The tray 200 may be provided in the form of a transport unit for causing the fascia 300 to be moved out of the main body 100. For example, the tray 200 may be installed on the upper side of the main body 100, namely in the housing 110 of the main body 100, so as to be able to move in the front-rear direction of the main body 100.

To this end, a sliding rail 214 capable of moving along the guide rail 131 of the main body plate 130 may be mounted on the lower surface of the tray 200. The sliding rail 214 may extend in the front-rear direction of the main body 100 on the lower surface of the tray 200 in alignment with the guide rail 131. The sliding rail 214 may be formed of a pair of rails juxtaposed on the lower surface of the tray 200.

The tray 200 may include a movable frame 210, a tray cover 230, a tray support 240 and a damper 250.

The movable frame 210 may include a horizontal plate 211 on a lower surface of which the sliding rail 214 is mounted, and a pair of vertical plates 212 vertically extending from both side edges of the horizontal plate 211. A cutout portion 213 in which at least a part of a keypad part 330 of the fascia 300 can be obliquely disposed may be formed at the front end of the horizontal plate 211.

In this regard, the cutout portion 213 may be provided to avoid interference with the components (e.g., the keypad part 330 and the like) attached to the fascia 300 or to form a clearance for the arrangement of components. In addition, the vertical plates 212 may extend downward from both side edges of the horizontal plate 211 so that the lower ends of the vertical plates 212 are flush with the lower surface of the tray cover 230. Thus, an arrangement space for obliquely installing the keypad part 330 may be provided on the front end side of the tray 200.

In this case, a support frame 220 on which the fascia 300 is mounted may be rotatably connected to the front end of the movable frame 210. As an example, the lower end of the support frame 220 may be rotatably connected to the front end of the movable frame 210 through a hinge shaft 260. As a result, when the support frame 220 is rotated toward the front side of the main body 100, the fascia 300 attached to the support frame 220 is also rotated toward the front side of the main body 100, whereby a work space for the maintenance of maintenance target members attached to the fascia 300 can be secured on the rear side of the support frame 220.

The fascia 300 may be mounted on the support frame 220. More specifically, a panel part 310 of the fascia 300 may be located on the front surface of the support frame 220. A display part 320 of the fascia 300 may be disposed on the upper side of the support frame 220. A keypad part 330 may be mounted on the lower side of the support frame 220.

Figure 5:
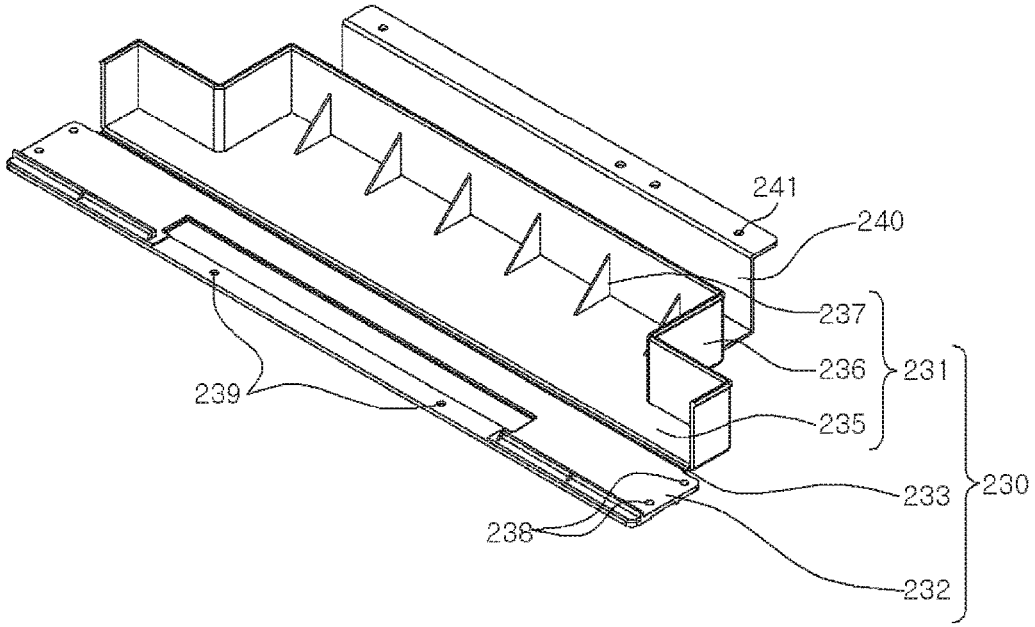
FIG. 5 is a perspective view showing a tray cover and a tray support according to one embodiment of the present disclosure.
Figure 6:
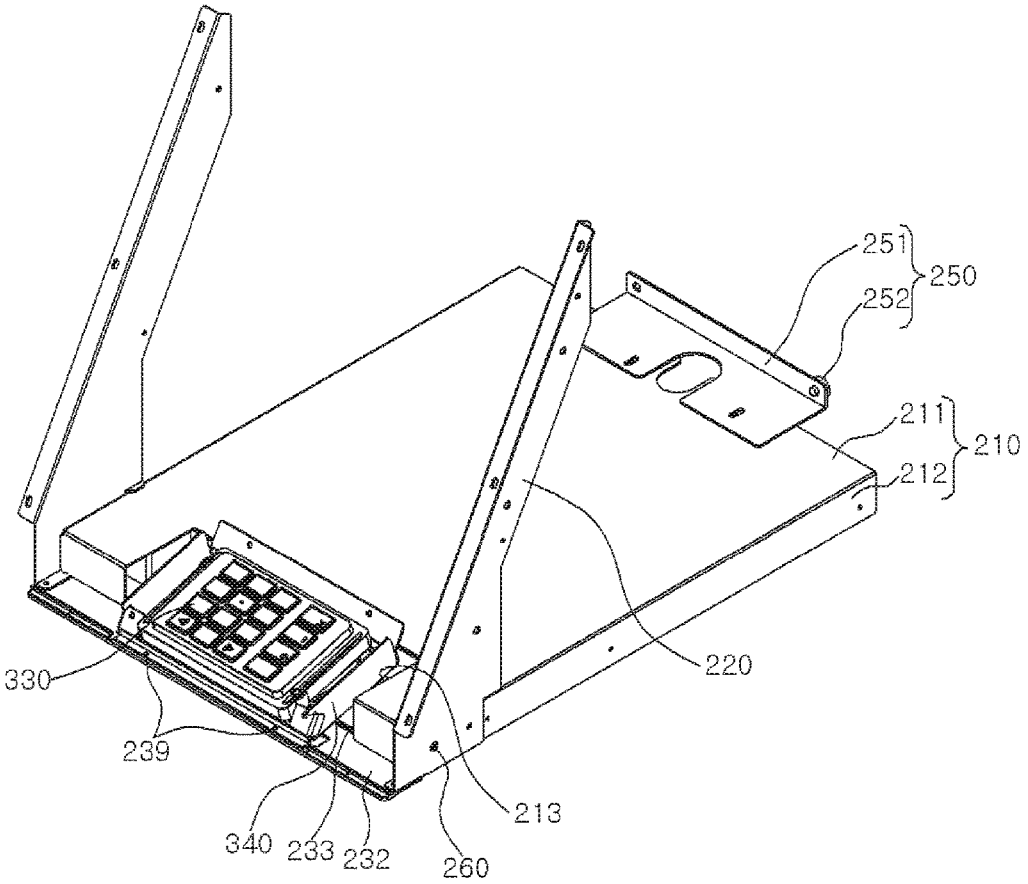
FIG. 6 is a perspective view showing a state in which a keypad part of a fascia is coupled to a tray in the automated teller machine according to one embodiment of the present disclosure.
Figure 7:
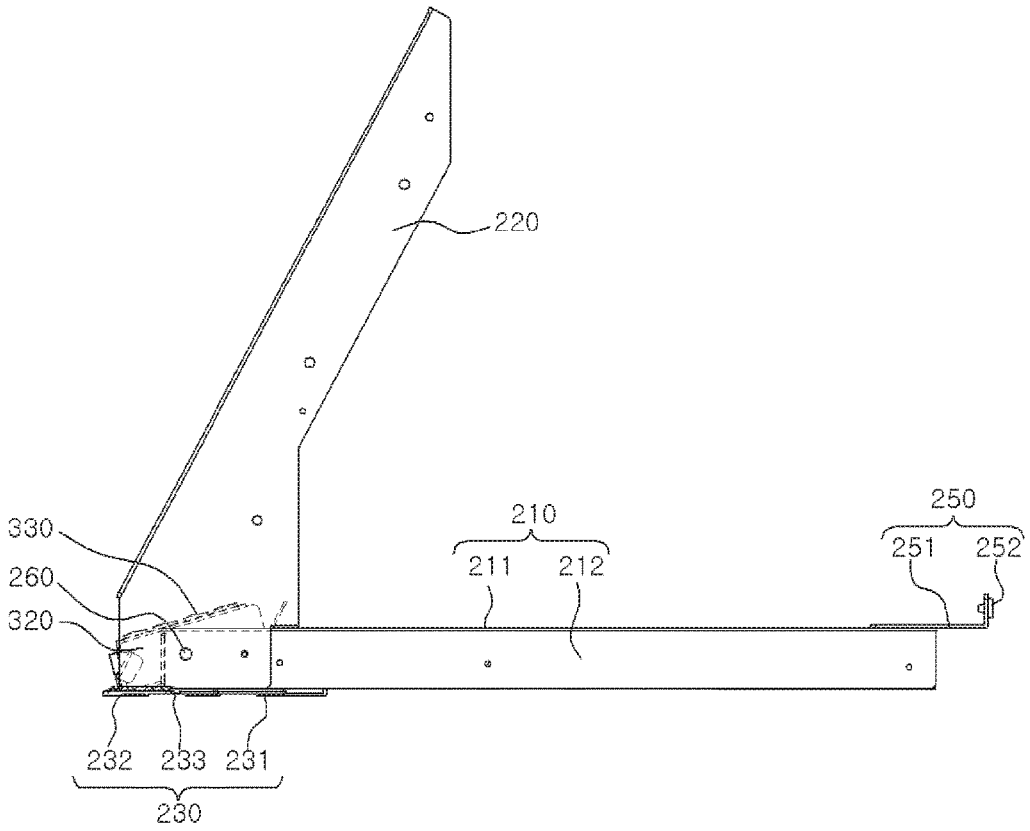
FIG. 7 is a side view showing a state in which the keypad part of the fascia is coupled to the tray in the automated teller machine according to one embodiment of the present disclosure.

FIG. 5 is a perspective view showing the tray cover and the tray support according to one embodiment of the present disclosure. FIG. 6 is a perspective view showing a state in which the keypad part of the fascia is coupled to the tray in the automated teller machine according to one embodiment of the present disclosure. FIG. 7 is a side view showing a state in which the keypad part of the fascia is coupled to the tray in the automated teller machine according to one embodiment of the present disclosure.

As shown in FIGS. 5 to 7, the tray cover 230 is located on the front side of the movable frame 210 to cover the lower side of the cutout portion 213. Therefore, when the chest 120 is opened by opening the chest door 140, it is possible to prevent the keypad part 330 of the fascia 300 from being exposed from below.

To this end, the tray cover 230 may include a cover body portion 231 for covering the lower side of the cutout portion 213, a cover bending portion 232 for supporting the lower end of the fascia 300, and a recessed connection portion 233 for connecting the cover body portion 231 and the cover bending portion 232.

In the present embodiment, there will be described a case where the member disposed in the cutout portion 213 is the keypad part 330. However, the present disclosure is not limited thereto. The member disposed in the cutout portion 213 may be one of the members to be subjected to maintenance when the fascia 300 is rotated toward the front side. For example, the member disposed in the cutout portion 213 may be one of a display part 320, a card insertion/removal part 350, a specification output part 360 and a speaker part 370, which will be described later.

In this regard, the cover body portion 231 may include a horizontal support member 235 having a larger area than the cutout portion 213, a vertical support member 236 extending upward from the edge of the horizontal support member 235, and a plurality of ribs 237 interconnecting the inner surface of the horizontal support member 235 and the inner surface of the vertical support member 236. In this manner, the cover body portion 231 has a predetermined height due to the existence of the vertical support member 236. Thus, the cover body portion 231 may provide an arrangement space in which the keypad part 330 of the fascia 300 is located to protrude downward through the cutout portion 213.

In addition, the cover bending portion 232 may have first fastening holes 238 for fastening the cover bending portion 232 to the lower end of the panel part 310 of the fascia 300 by bolts and second fastening holes 239 for fastening the cover bending portion 232 to the lower end of the support frame 220 by bolts.

In particular, the cover bending portion 232 is bendably connected to the cover body portion 231 through the recessed connection portion 233. Therefore, when the support frame 220 is rotated, the recessed connection portion 233 may be folded and rotated together with the support frame 220. At this time, the cover bending portion 232 is rotated together with the support frame 220 in a state in which the cover bending portion 232 is coupled to the support frame 220. This enables the tray cover 230 to reliably prevent the access of unauthorized persons to the rotating region between the movable frame 210 and the support frame 220.

The tray support 240 may be provided in the form of a bracket fixed to the front side of the movable frame 210 to support the rear side of the tray cover 230. For example, the rear end of the tray support 240 may be fixed to the front side of the movable frame 210 by typical bolts passing through support holes 241. The front end of the tray support 240 may be bent to support the rear side of the tray cover 230.

The damper 250 may be provided at the rear end of the support frame 220 and may reduce a shock generated when the tray 200 collides with the rear wall of the main body 100. The damper 250 may include a damper bracket 251 provided at the rear end of the support frame 220 and a damper rubber 252 provided at the damper bracket 251.

Referring again to FIGS. 1 and 2, the fascia 300 is a control panel for inputting various kinds of information necessary for financial transactions. The fascia 300 may be installed on the front upper side of the main body 100, more specifically, on the front side of the tray 200.

The fascia 300 may include a panel part 310 installed on the front side of the support frame 220, a pad bracket part 340 (see FIGS. 6 and 7) obliquely disposed on the lower side of the panel part 310, a keypad part 330 mounted on the pad bracket part 340, a display part 320 mounted on the upper side of the panel part 310, a card insertion part 350 for inserting a card, a specification output part 360 for outputting a specification or the like, and a speaker part 370 for outputting a sound and a voice.

In this regard, a fixing key 311 for selective locking with the housing 110 of the main body 100 may be provided at the upper end of the panel part 310 (see FIG. 1). The lower end of the panel part 310 may be fixed to the cover bending portion 232 of the tray cover 230 by bolts. The keypad part 330 may be formed of an EPP (Encrypting Pin Pad) capable of encrypting input information.

In particular, the positions of major components of the fascia 300 may be determined depending on the convenience of a user. For example, the keypad part 330 is obliquely installed at a predetermined angle by the pad bracket part 340 to enable a user to input personal information. Therefore, a user can easily recognize key portions of the keypad part 330 and can conveniently input personal information using the keypad part 330.

Hereinafter, description will be made on a process of drawing out the tray from the automated teller machine in order to perform maintenance for the fascia.

Figure 8:
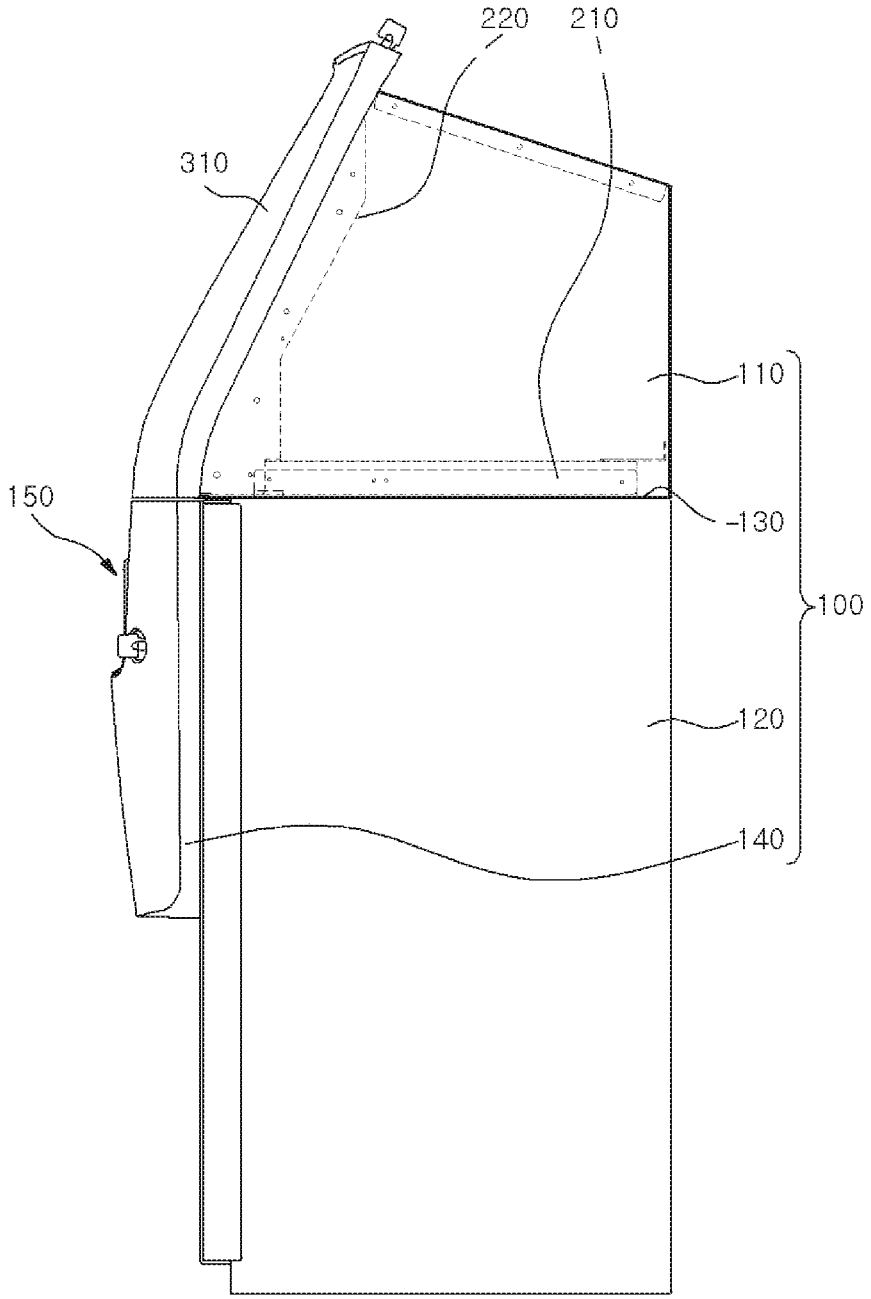
FIG. 8 is a side view showing the automated teller machine according to one embodiment of the present disclosure.
Figure 9:
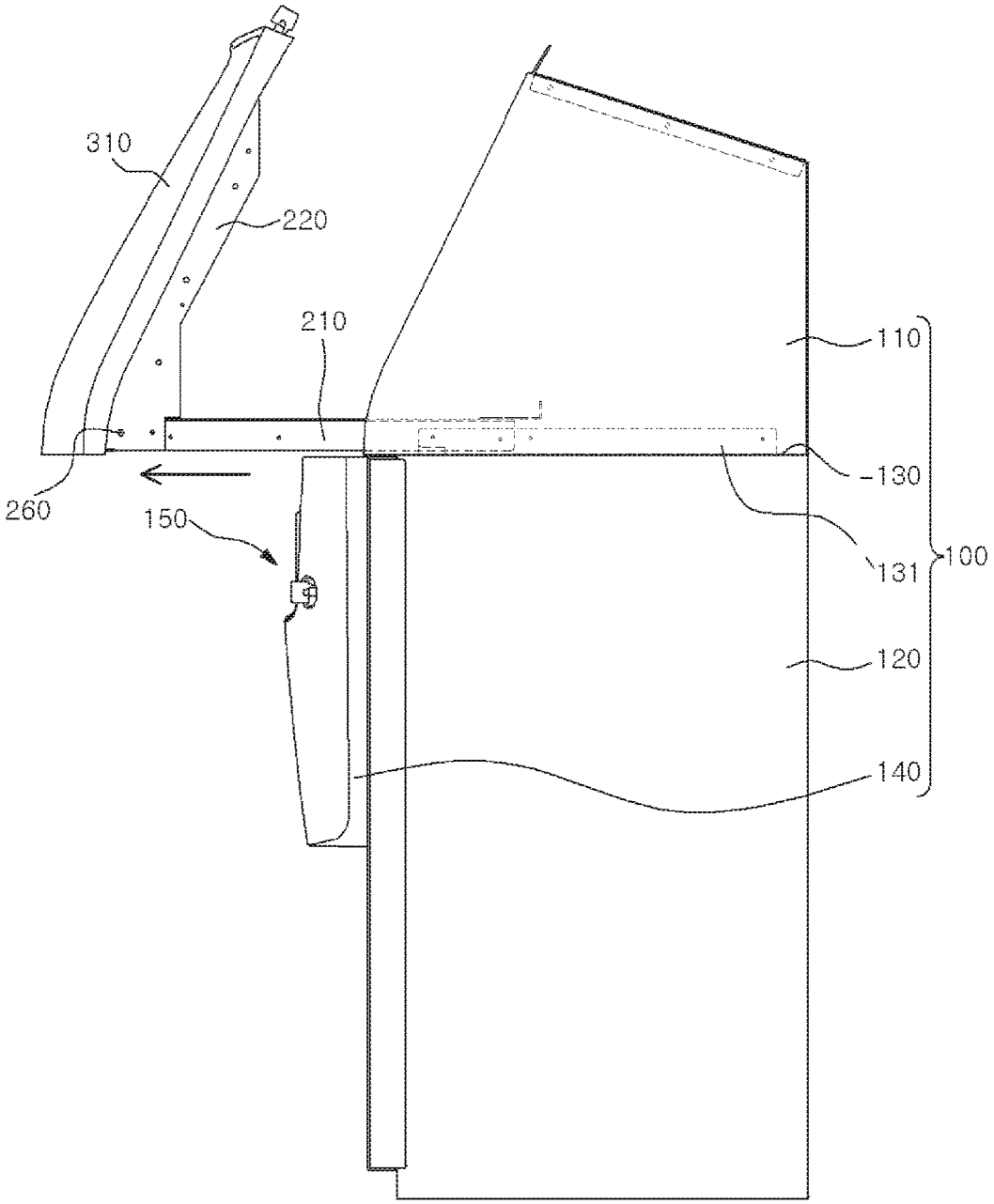
FIG. 9 is a view showing a state in which the tray is drawn out in the automated teller machine according to one embodiment of the present disclosure.
Figure 10:
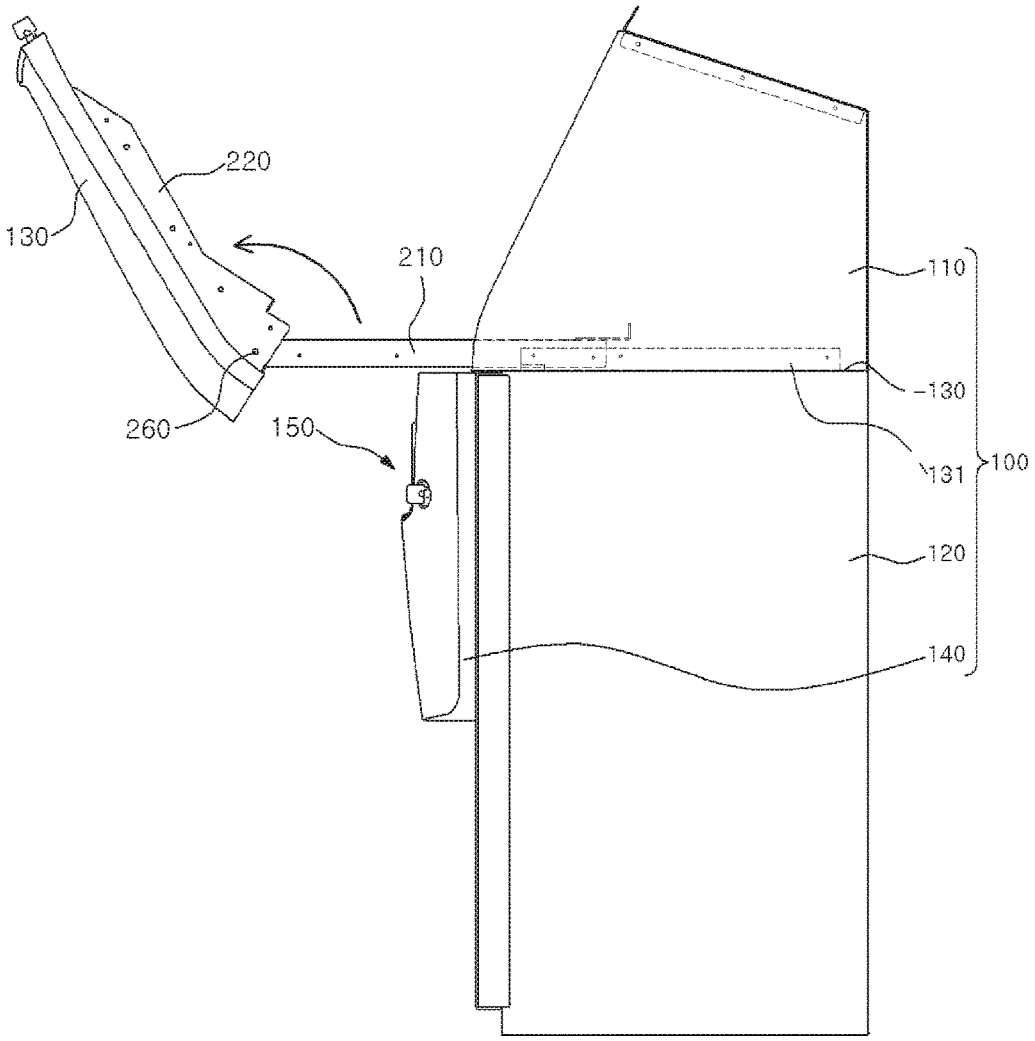
FIG. 10 is a view showing a state in which the fascia is rotated from the drawn-out tray in the automated teller machine according to one embodiment of the present disclosure.

FIG. 8 is a side view showing the automated teller machine according to one embodiment of the present disclosure. FIG. 9 is a view showing a state in which the tray is drawn out in the automated teller machine according to one embodiment of the present disclosure. FIG. 10 is a view showing a state in which the fascia is rotated.

As shown in FIG. 8, prior to drawing out the tray 200 from the housing 110 of the main body 100, the fixing key 311 is first unlocked in order to separate the panel part 310 of the fascia 300 from the housing 110 of the main body 100.

At this time, the tray cover 230 continues to cover the lower side of the cutout portion 213 of the tray 200. Therefore, even if the accommodation space of the chest 120 is opened by opening the chest door 140, it is possible to prevent the keypad part 330 of the fascia 300 from being exposed from below.

As shown in FIG. 9, if the fixing key 311 is unlocked, an operator can move the sliding rail 214 of the tray 200 along the guide rail 131 of the main body plate 130, whereby the tray 200 can be stably moved toward the front side of the main body 100.

As shown in FIG. 10, if the tray 200 is drawn out toward the front side of the main body 100, the operator can rotate the support frame 220, on which the fascia 300 is mounted, toward the front side of the main body 100, more precisely, counterclockwise in FIG. 10. At this time, the rear surface of the fascia 300 is exposed, whereby a work space for maintenance of the fascia 300 can be provided on the rear side of the fascia 300.

Particularly, when the fascia 300 is rotated, i.e., when the support frame 220 is rotated, the cover bending portion 232 of the tray cover 230 is also rotated together with the support frame 220. This enables the tray cover 230 to reliably prevent the access of unauthorized persons to the rotating region between the movable frame 210 and the support frame 220.

As described above, according to the present disclosure, the gap left between the tray and the keypad part disposed in the cutout portion is covered by the tray cover for protecting the cutout portion of the tray. It is therefore possible to effectively prevent the keypad part from being exposed to a security risk when a chest is opened. Furthermore, the fascia is rotatably installed at the movable frame. This provides an advantage in that when the fascia is rotated, it is possible to secure a work space for effective maintenance of the fascia.

While the embodiments of the present disclosure have been described with reference to the accompanying drawings, it will be understood by those skilled in the art that the present disclosure can be implemented in other specific forms without changing the technical spirit or essential features of the present disclosure. For example, those skilled in the art can implement the present disclosure in the form that is not clearly described in the embodiments of the present disclosure by changing materials, sizes and the like of the respective components depending on application fields or by combining or replacing the embodiments without departing from the scope of the present disclosure. Therefore, it should be noted that the above-described embodiments are merely illustrative in all aspects and are not to be construed as limiting the present disclosure and also that the modifications are included in the technical spirit of the present disclosure which is described in the following claims.

What is claimed is:

1. An automated teller machine, comprising:

a main body provided with a guide rail extending in a front-rear direction;

a tray mounted in the main body, the tray being movable along the guide rail into and out of the main body; and a fascia rotatably coupled to the tray at a front side of the tray, wherein the tray includes a movable frame configured to move along the guide rail and provided with a cutout portion at a front end thereof, and a tray cover provided at a front side of the movable frame to cover the cutout portion from below.

2. The automated teller machine of claim 1, wherein the tray cover includes:

a cover body portion configured to cover the cutout portion;

a cover bending portion configured to support a lower end of the fascia; and a recessed connection portion which bendably connects the cover body portion and the cover bending portion.

3. The automated teller machine of claim 1, wherein the tray further includes a tray support fixed to a front side of the movable frame to support a rear side of the tray cover.

4. The automated teller machine of claim 1, wherein the fascia includes:

a panel part rotatably installed at a front end of the movable frame;

a pad bracket part obliquely disposed at a lower side of the panel part;

a keypad part mounted on the pad bracket part to allow a user to input personal information; and a display part mounted at an upper side of the panel part.

5. The automated teller machine of claim 1, wherein the main body includes:

a housing mounted so that the tray is moved into and out of the housing;

a chest located on a lower side of the housing and configured to store bills;

a main body plate configured to partition the housing and the chest, the guide rail mounted on the main body plate;

a chest door configured to open and close the chest; and a deposit/withdrawal stack part provided in the chest door so that bills are deposited and withdrawn through the deposit/withdrawal stack part.

6. An automated teller machine, comprising:

a housing forming an upper outer shell of the automated teller machine together with a fascia defining a front surface of the automated teller machine;

a chest installed on a lower side of the housing;

a tray coupled to the fascia and configured to slidingly move into and out of the housing; and a tray cover installed at a lower portion of the tray and configured to prevent access to an interior of the housing through a gap between the fascia and the tray.

7. The automated teller machine of claim 6, wherein the fascia includes a keypad part configured to receive an input of information, a cutout portion is formed in the tray to avoid interference of the tray with the keypad part, and the tray cover extends to the cutout portion to prevent access to the interior of the housing.

8. The automated teller machine of claim 7, wherein the tray cover includes:

a cover body portion installed below the cutout portion to cover the cutout portion; and a cover bending portion connected to the cover body portion to cover a gap between the fascia and the tray.

9. The automated teller machine of claim 8, wherein a lower end portion of the fascia is hingedly coupled to the tray, and the cover bending portion is connected to the cover body portion through a recessed connection portion so that the cover bending portion is rotated together with the fascia when the fascia is rotated frontward.

* * * * *